US012122490B2

(12) United States Patent
Kenner

(10) Patent No.: US 12,122,490 B2
(45) Date of Patent: Oct. 22, 2024

(54) FLAT-BOTTOM FLUVIAL TRANSPORT BOAT COMPRISING INFLATABLE BUOYANCY TANKS

(71) Applicant: BK Trading, Venissieux (FR)

(72) Inventor: Bruno Kenner, Venissieux (FR)

(73) Assignee: BK TRADING, Venissieux (FR)

( * ) Notice: Subject to any disclaimer, the term of this patent is extended or adjusted under 35 U.S.C. 154(b) by 350 days.

(21) Appl. No.: 17/424,372

(22) PCT Filed: Jan. 16, 2020

(86) PCT No.: PCT/FR2020/050061

§ 371 (c)(1),
(2) Date: Jul. 20, 2021

(87) PCT Pub. No.: WO2020/152409

PCT Pub. Date: Jul. 30, 2020

(65) Prior Publication Data

US 2022/0111939 A1 Apr. 14, 2022

(30) Foreign Application Priority Data

Jan. 21, 2019 (FR) ..... 1900486

(51) Int. Cl.

| | |
|---|---|
| ***B63B 43/14*** | (2006.01) |
| ***B63B 35/00*** | (2020.01) |
| ***B63B 35/28*** | (2006.01) |
| ***B63B 43/18*** | (2006.01) |

(52) U.S. Cl.

CPC ..... *B63B 43/14* (2013.01); *B63B 2035/002* (2013.01); *B63B 35/28* (2013.01); *B63B 2043/145* (2013.01); *B63B 2043/185* (2013.01)

(58) Field of Classification Search

CPC ..... B63B 43/00; B63B 43/02; B63B 43/04; B63B 2043/042; B63B 2043/047; B63B 43/06; B63B 43/10; B63B 43/14; B63B 2043/145; B63B 2043/185; B63B 35/28; B63B 2035/002; B63C 7/00; B63C 7/04

USPC ..... 114/121, 122, 123, 271, 278, 283, 284, 114/287, 292

See application file for complete search history.

(56) References Cited

U.S. PATENT DOCUMENTS

| | | | | |
|---|---|---|---|---|
| 6,469 A * | 5/1849 | Lincoln | ..... | B63C 7/04 114/123 |
| 7,644,673 B2 * | 1/2010 | Schmitt | ..... | B63B 43/14 114/68 |
| 9,180,945 B1 * | 11/2015 | Mears | ..... | B63C 7/00 |

FOREIGN PATENT DOCUMENTS

| | | | |
|---|---|---|---|
| CN | 106628044 | A | 5/2017 |
| CN | 105711771 | B | 11/2020 |
| FR | 2810624 | B1 | 6/2004 |
| GB | 2284577 | A | 6/1995 |

(Continued)

OTHER PUBLICATIONS

International Search Report for International Application No. PCT/FR2020/050061 dated Jun. 5, 2020, 2 pages.

(Continued)

*Primary Examiner* — Daniel V Venne
(74) *Attorney, Agent, or Firm* — TraskBritt

(57) ABSTRACT

A flat-bottom fluvial transport boat comprising inflatable buoyancy tanks consisting of at least one pair of port side and starboard inflatable volumes. The paired inflatable volumes are connected to each other by means of one or more pressure balancing means.

7 Claims, 3 Drawing Sheets

(56) References Cited

FOREIGN PATENT DOCUMENTS

| | | |
|---|---|---|
| GB | 2354487 A | 3/2001 |
| GB | 2369803 A | 6/2002 |

OTHER PUBLICATIONS

International Written Opinion for International Application No. PCT/FR2020/050061 dated Jun. 5, 2020, 6 pages.

* cited by examiner

FLAT-BOTTOM FLUVIAL TRANSPORT BOAT COMPRISING INFLATABLE BUOYANCY TANKS

CROSS-REFERENCE TO RELATED APPLICATIONS

This application is a national phase entry under 35 U.S.C. § 371 of International Patent Application PCT/FR2020/050061, filed Jan. 16, 2020, designating the United States of America and published as International Patent Publication WO 2020/152409 A1 on Jul. 30, 2020, which claims the benefit under Article 8 of the Patent Cooperation Treaty to French Patent Application Serial No. 1900486, filed Jan. 21, 2019.

TECHNICAL FIELD

The present disclosure relates to the field of self-propelled or non-self-propelled barges for transporting freight on canals, in particular, so-called "Freycinet gauge" canals or rivers, and for occasional use on shallow water bodies. It relates more particularly to boats intended mainly for river navigation, and occasionally for navigation on inland seas or lakes.

The goods, generally dry, are stored in a non-specialized hold, accessible and covered with sliding and removable panels (hatch covers).

The most common self-propelled barge in the state of the art, currently made of steel, is called a "peniche Freycinet." It measures 38.50 m long by 5.05 m wide and has at its rear a wheelhouse station above an engine compartment that is accessed by an engine companionway leading to the wheelhouse level.

A self-propelled barge has its own propulsion device with a simple structure to allow for easy docking and for the hull to orient itself appropriately. The self-propelled barge comprises an engine room with a propulsion engine placed at the stern of the hull and providing self-propulsion. A deck and a cabin are located in front of the hold of the hull, which corresponds to the engine room to allow for approaching the quay and for orienting the hull.

A non-self-propelled barge is a non-motorized, flat-bottomed boat, not steered by a rudder and intended for the storage and movement of goods, generally dry, stored in a non-specialized hold, accessible and possibly covered by sliding and removable panels (hatch covers).

The current non-self-propelled barges are pushed by powerful motorized boats known as "push boats."

The present disclosure relates more particularly to self-propelled or non-self-propelled barges equipped with inflatable elements allowing buoyancy to be increased when the available lateral navigable space allows for their deployment.

BACKGROUND

Patent GB2284577 discloses a system for controlling the distribution of the load-bearing force of flexible, inflatable, buoyancy bags. This system makes it possible to increase the lateral bearing force of boats by cancelling inflation of damaged units by means of pressure drop detection elements placed in permanently pressurized bags through signals generated by the pressure switch. It concerns a deep-sea navigation boat and not a river boat. The bags are intended to mitigate a risk of sinking and are not for normal use.

The utility model CN105711771 is for a device that may prevent a maritime boat from sinking when accidental damage occurs to the hull of the boat and water enters the boat through breaches in the hull during navigation, or it allows the boat not to tip over so as not to sink when the boat is destabilized by the wind.

It provides for a gas storage and charging device and a gas supply pipeline system installed on the hull of the boat; one fixed-type inflatable bag and one non-fixed type inflatable bag installed and stored in a boat cabin. The floats are connected to the air supply system. The floats are not normally used; when the boat is in danger, the inflatable bags are put in place.

Patent application GB2354487 describes another example of a boat that has longitudinal inflatable bags mounted along both sides. The bags may be attached to an existing hull or placed in a recess formed in a new hull. The inflation apparatus for the bags may include gas reservoirs, a feeding pressure and supply regulation apparatus, which, in turn, feeds a gas supply tube to inflate the bags through non-return valves. The air bags may be protected by a rubber housing 5, on inflation of the inflatable chambers. The chambers may be inflated manually, in response to a hydrostatic activation, or in response to a remote signal.

Patent GB2369803A relates to a boat comprising an inflatable flotation device arranged on the boat such that when it is inflated by an inflation means, it is able to maintain the boat's buoyancy at the water line level in the event of the boat taking on an amount of water that would otherwise cause the boat to sink.

Patent CN106628044 describes a boat anti-rollover and anti-sinking air bag system. Through the buoyancy of air bags, which may be rapidly and automatically expanded and inflated, a boat is prevented from rolling over or sinking. The boat anti-rollover and anti-sinking air bag system is a study in the field of boat safety. According to drawings, the boat anti-rollover and anti-sinking air bag system is characterized in that an electronic sensing control device decides whether to give a command and trigger the corresponding safety air bags through collection and processing of data, including the boat heeling degree and the flooding degree, obtained by a gravity inclination angle sensor and a water sensor.

The solutions of the prior art relate to solutions for preventing the boat from sinking in the event of a shipwreck, and therefore a major loss of buoyancy.

These solutions result in excessive lateral size and weight due to the floats and the associated mechanics reducing the transport capacity.

For transport boats circulating mainly on small gauge canals and rivers, passing through locks, and occasionally navigating on bodies of water with a low water level, the solutions of the prior art do not allow sufficient flexibility to adapt to all the circumstances encountered.

BRIEF SUMMARY

In order to respond to these drawbacks, the present disclosure relates in its most general sense to a fluvial transport boat, comprising inflatable buoyancy tanks composed of at least one pair of port and starboard inflatable watertight volumes, which will be called inflatable bladders or volumes, characterized in that the bladders are inflatable in pairs with pressure balancing means.

For the purposes of the present patent, "fluvial transport boat" will be understood to mean a boat intended exclusively or partially for the transport of goods on inland waterways, whether they are navigable watercourses, possibly developed, or, for example, artificial canals. "Fluvial transport boat" within the meaning of the present patent does not constitute a maritime boat intended for deep-sea or coastal navigation at sea.

A flat-bottomed, "coaster"-type boat that may navigate either by sea or river is considered a "fluvial transport boat" within the meaning of the present patent.

Technically, fluvial transport boats are distinguished from maritime boats by their gauge imposed by the dimensions of the waterways.

Advantageously, each of the inflatable volumes has a prismatic shape with a cross section widening upward.

According to variants taken individually or in any technically realistic combination:

- it further comprises a semi-rigid plate covering the outer face of the sealed bladder, the rigid plate being articulated by a longitudinal hinge arranged below the inflatable bladder;
- the semi-rigid plate may, inter alia, be composed of a titanium sheet;
- it further comprises a rigid plate covering the outer face of the inflatable volumes, the rigid plate being articulated by a longitudinal hinge arranged below the inflatable volume;
- the rigid plate may, inter alia, be composed of a shape memory material;
- the upper face of the inflatable bladder has at least one mechanical, hydraulic, or pneumatic shape control means;
- the upper face of the inflatable volume has at least one electronic shape control means;
- the upper face of the inflatable bladder has at least one hooking means for a hanger, the opposite end of which is fixed to the upper edge of the hull of the boat; and
- the inflatable volumes are composed of neoprene fabrics.

BRIEF DESCRIPTION OF THE DRAWINGS

The present disclosure will be better understood on reading the detailed description of a non-limiting example of the present disclosure that follows, with reference to the accompanying drawings, where.

DETAILED DESCRIPTION

Figure 1:
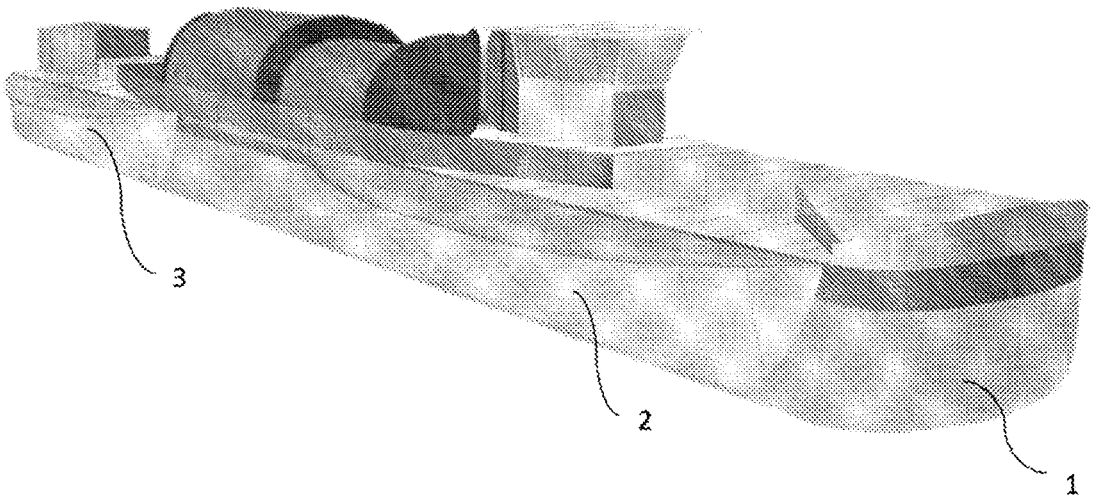
FIG. 1 depicts a three-quarter front view of a boat according to the present disclosure.
Figure 2:
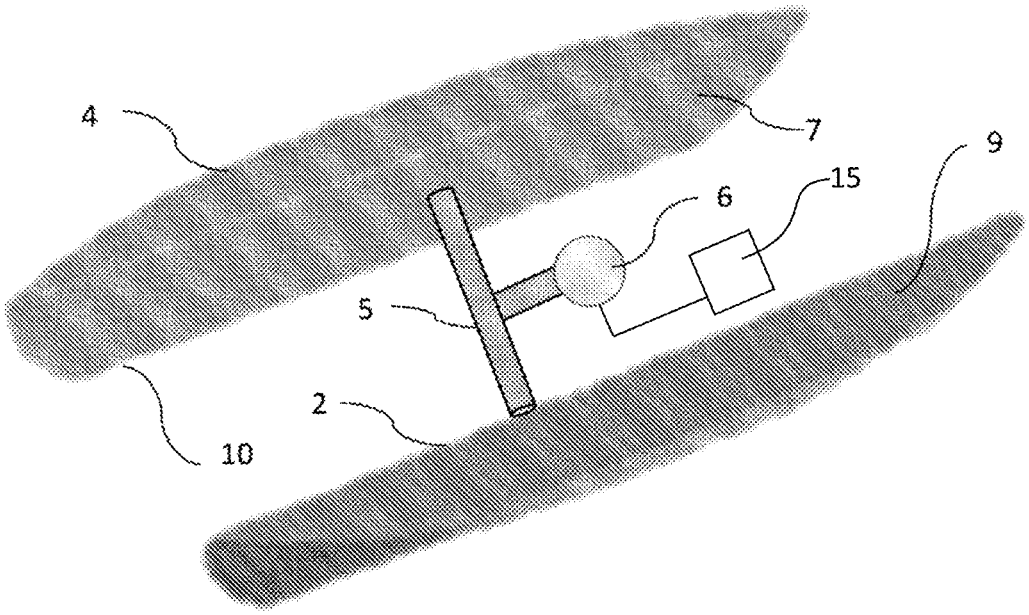
FIG. 2 depicts a perspective view of a pair of floats according to the present disclosure.

FIG. 1 depicts an overall view of the boat according to the present disclosure. It is composed of a hull (1) with a flat bottom, carrying inflatable volumes (2, 3) on its side flanks. These inflatable volumes (2, 3) are composed of a sealed envelope, for example, made of neoprene fabrics, and form port-starboard pairs that are symmetrical with respect to the median plane of the boat.

In the example described, the hull (1) comprises two pairs of inflatable volumes (2, 3), one at the front, the other at the rear.

These inflatable volumes (2, 3) are not intended to compensate for a loss of buoyancy, for example, in the event of a shipwreck, but to modify the nominal flotation mode between a first mode limiting the lateral size (volumes deflated) and a second mode limiting the draft (volumes (2, 3) inflated) in a balanced manner for the volumes arranged on either side of the center line of the boat.

The passage between the two navigation modes of the fluvial boat according to the present disclosure is achieved by modifying the W/D ratio where W designates the maximum width of the boat, and D designates the draft.

This modification is carried out by controlling the inflation of the volumes (2, 3) comprising buoyancy tanks to reduce the draft, or conversely by controlling the deflation of the volumes (2, 3) to reduce the lateral size of the boat.

Description of the Bladders

In this example, the inflatable volumes (2, 4) have an elongated prismatic shape. The inner face (7) of each inflatable volume (2, 4) has a shape corresponding to the outer surface of the hull.

The outer face has a convex shape with a lower fold running along the hull. The upper part (9) has an arched shape and may be folded to reduce the width.

The two inflatable volumes (2, 4) of a pair are connected by one or more ducts (5) in order to balance the pressure in the two inflatable volumes. The inflation is carried out by a pump (6) opening into a duct (5) connecting the two inflatable volumes (2, 4).

The maximum cumulative volume V of the inflatable volumes is determined to ensure a difference AL in draft between the minimum lateral size mode and the minimum draft mode, such that without inflation, the draft is nominal and compatible with the depth of the canals or waterways, and with inflation, the water level is compatible with the highest areas and the admissible lateral size.

Alternatively, an electronic circuit 15 may control in real time the inflation/deflation of each of the inflatable volumes of a pair to permanently maintain a balance.

This pump (6) inflates the inflatable volumes to ensure their deployment symmetrically with respect to the longitudinal plane of the boat, due to the pressure balancing; as well as deflation to reduce the midship. This inflation is controlled either pneumatically by connecting the two paired inflatable volumes via an open duct, or electronically by controlling inflation pumps for each of the paired inflatable volumes.

The inflatable volumes (2, 4) each have the shape of a port and starboard half-hull, respectively.

The bottom (10) of the inflatable volume is hemmed and has a width limited substantially to the thickness of the envelope of the bladder. The inflatable volume then becomes broader by a variable bulge (12), closed at its upper part.

Figure 3:
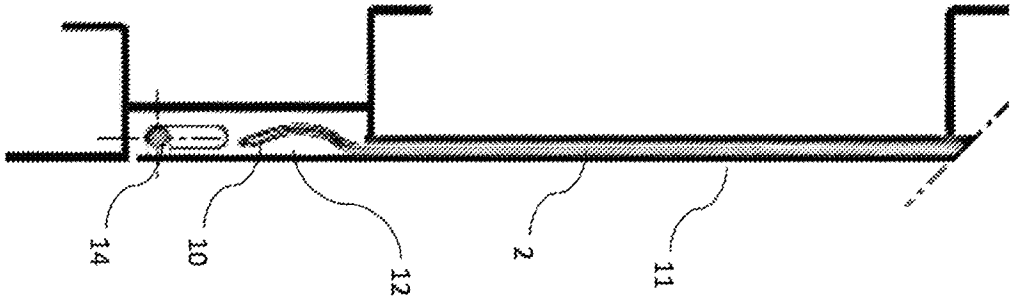
FIG. 3 depicts the deflated bladder.
Figure 4:
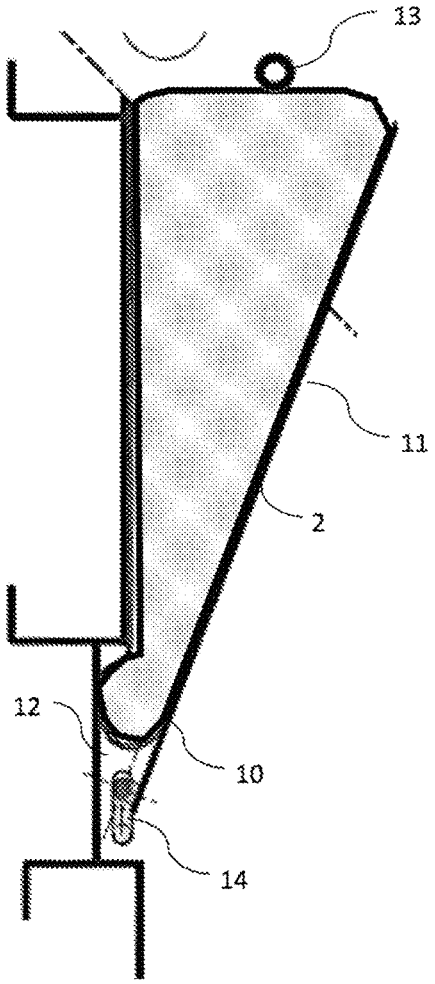
FIG. 4 depicts the inflated bladder.

FIGS. 3 and 4 show the inflatable volumes, respectively, in the folded position and in the deployed position.

The outer surface of the bladder (2) is covered by a metal sheet (11), for example, made of titanium, spring steel, composite, or any other material with high shape memory. This sheet is articulated at its lower part by a hinge (14). The hemmed bottom (10) of the inflatable volume (2) may be housed in a longitudinal cavity (12). The upper edge of the bladder may have anchorages (13) for connection by hangers with a high point of the boat.

The invention claimed is:

1. A fluvial boat for transporting goods comprising inflatable buoyancy tanks composed of at least one pair of port and starboard inflatable volumes, wherein the at least one pair of port and starboard inflatable volumes are connected by one or more ducts configured to balance pressure between the at least one pair of port and starboard inflatable volumes, and in that the fluvial boat comprises a pump configured to modify a W/D ratio where W denotes a maximum width of the fluvial boat, and D denotes a draft of the fluvial boat, the pump controlling an inflation of the inflatable buoyancy tanks to reduce the draft and a deflation of the inflatable buoyancy tanks to reduce a lateral size of the fluvial boat.

2. The fluvial boat for transporting goods according to claim 1, wherein each inflatable volume of the at least one pair of port and starboard inflatable volumes has a prismatic shape with a cross section widening upward.

3. The fluvial boat for transporting goods according to claim 1, further comprising a rigid plate covering an outer face of each inflatable volume of the at least one pair of port and starboard inflatable volumes, the rigid plate being articulated by a longitudinal hinge arranged below the inflatable volume.

4. The fluvial boat for transporting goods according to claim 3, wherein the rigid plate is composed of a shape memory material.

5. The fluvial boat for transporting goods according to claim 1, wherein an upper face of each inflatable volume of the at least one pair of port and starboard inflatable volumes are configured to be manipulated by the pump.

6. The fluvial boat for transporting goods according to claim 1, wherein an upper face of each inflatable volume of the at least one pair of port and starboard inflatable volumes are configured to be manipulated by at least one electronic circuit.

7. The fluvial boat for transporting goods according to claim 1, wherein an upper face of each inflatable volume of the at least one pair of port and starboard inflatable volumes has an anchorage for a hanger, the opposite end of which is fixed to an upper edge of a hull of the fluvial boat.

* * * * *